US012686522B2

(12) United States Patent
Höynck

(10) Patent No.: US 12,686,522 B2
(45) Date of Patent: Jul. 21, 2026

(54) METHOD AND DEVICE FOR FILLING BAGS

(71) Applicant: Focke & Co. (GmbH & Co. KG), Verden (DE)

(72) Inventor: Benjamin Höynck, Hamburg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 100 days.

(21) Appl. No.: 18/258,001

(22) PCT Filed: Dec. 17, 2021

(86) PCT No.: PCT/EP2021/086460
§ 371 (c)(1),
(2) Date: Jun. 26, 2023

(87) PCT Pub. No.: WO2022/129506
PCT Pub. Date: Jun. 23, 2022

(65) Prior Publication Data
US 2024/0051696 A1 Feb. 15, 2024

(30) Foreign Application Priority Data
Dec. 18, 2020 (DE) ..... 102020134136.9

(51) Int. Cl.
*B65B 67/12* (2006.01)
*B65B 5/06* (2006.01)
(Continued)

(52) U.S. Cl.
CPC ..... *B65B 67/1233* (2013.01); *B65B 5/067* (2013.01); *B65B 25/20* (2013.01);
(Continued)

(58) Field of Classification Search
CPC ..... B65B 67/1233; B65B 5/067; B65B 5/045
See application file for complete search history.

(56) References Cited

U.S. PATENT DOCUMENTS 3,877,562 A 4/1975 Shaw
5,544,466 A * 8/1996 Bonnet ..... B65B 51/00 53/253
7,134,256 B2 * 11/2006 Kujubu ..... B65B 25/065 53/64

FOREIGN PATENT DOCUMENTS

DE 4105452 A1 8/1992
DE 19749825 A1 5/1999
(Continued)

OTHER PUBLICATIONS

WIPO, International Search Report (in a corresponding application), Apr. 19, 2022.
(Continued)

*Primary Examiner* — Daniel Jeremy Leeds
(74) *Attorney, Agent, or Firm* — Laurence P. Colton; Smith Tempel Blaha LLC

(57) ABSTRACT

A device and a method for filling bags with products, wherein the bags have an opening via which the bags are each filled with at least one product, wherein walls of the bag are spaced apart from one another in the region of the opening in order to introduce the at least one product into the bag via the opening, and wherein, after the walls are spaced apart and before the at least one product is supplied, holding elements are introduced into the bag through the opening in order to hold the open bag in the region of the opening. At least some holding elements have at least one shaping element against which a wall of the bag bears in each case such that the material of the wall is preferably plastically deformed in order to hold the wall on the respective holding element via the respective shaping element.

17 Claims, 6 Drawing Sheets

(51) Int. Cl.

| | |
|---|---|
| ***B65B 25/20*** | (2006.01) |
| ***B65B 35/40*** | (2006.01) |
| ***B65B 43/30*** | (2006.01) |
| ***B65B 43/46*** | (2006.01) |
| ***B65B 63/02*** | (2006.01) |

(52) U.S. Cl.
CPC ..... *B65B 35/40* (2013.01); *B65B 43/30* (2013.01); *B65B 43/465* (2013.01); *B65B 63/02* (2013.01); *B65B 67/1255* (2013.01)

(56) References Cited

FOREIGN PATENT DOCUMENTS

| | | | |
|---|---|---|---|
| DE | 69614456 | T2 | 4/2002 |
| DE | 102006028796 | A1 | 12/2007 |
| DE | 102011105967 | A1 | 1/2013 |

OTHER PUBLICATIONS

Deutsches Patent—Und Markenamt (German Patent and Trademark Office), Recherchebericht (search in a corresponding application), Sep. 14, 2021.

* cited by examiner

METHOD AND DEVICE FOR FILLING BAGS

CROSS REFERENCE TO RELATED APPLICATIONS

This application is the US national phase of and claims the benefit of and priority on International Application No. PCT/EP2021/086460 having an international filing date of 17 Dec. 2021, which claims priority on and the benefit of German Patent Application No. 10 2020 134 136.9 having a filing date of 18 Dec. 2020.

BACKGROUND OF THE INVENTION

Technical Field

The invention relates to a method for filling bags with products, wherein the bags have an opening via which the bags are each filled with at least one product, and wherein walls of the bag are spaced apart from one another in the region of the opening in order to introduce the at least one product into the bag via the opening, and wherein, after the walls are spaced apart and before the at least one product is supplied, holding elements are introduced into the bag through the opening in order to hold the open bag in the region of the opening.

The invention also relates to a corresponding device for filling bags with products, preferably by a method as taught herein, wherein the bags have an opening via which the bags can each be filled with at least one product, and wherein walls of the bag can be spaced apart from one another in the region of the opening in order to introduce the at least one product into the bag via the opening, and wherein, after the walls are spaced apart and before the at least one product is supplied, holding elements are introduced into the bag through the opening in order to hold the open bag in the region of the opening.

Prior Art

In practice, the procedure is often such that the bags are kept ready in a state lying flat and spread out, for example in a stack. An (upper) bag wall can be lifted in order to open the bag (slightly or a little). This can be done for example using one or more suction elements, which act on the outside of a bag wall and carry along the latter in order to open the bag. Alternatively, however, it is also known to ensure corresponding opening of the bag by means of a puff of compressed air. Holding elements are then introduced into the bag in order to unfold the bag and thus prepare it for the supply of products.

The methods and devices as known in practice generally function reliably to some extent overall. However, it is problematic that the bags (in particular large or heavy bags) tend to slip off the holding elements. Corresponding countermeasures by clamping the bag wall can, however, result in damage to the material of the bag.

BRIEF SUMMARY OF THE INVENTION

Proceeding from this, the invention is based on the object of refining methods and devices of the type mentioned at the outset, in particular with regard to improved handling of the opening of the bags.

A method according to the invention is a method for filling bags with products, wherein the bags have an opening via which the bags are each filled with at least one product, and wherein walls of the bag are spaced apart from one another in the region of the opening in order to introduce the at least one product into the bag via the opening, and wherein, after the walls are spaced apart and before the at least one product is supplied, holding elements are introduced into the bag through the opening in order to hold the open bag in the region of the opening, characterized in that at least some holding elements each have at least one shaping element against which a wall of the bag bears in each case such that the material of the wall is preferably plastically deformed in order to hold the wall on the respective holding element via the respective shaping element. Accordingly, it is provided for at least some holding elements each to have at least one shaping element against which a wall of the bag bears in each case such that the material of the wall is preferably plastically deformed in order to hold the wall on the respective holding element via the respective shaping element.

In other words, it is provided for the bag to be (plastically) deformed by bearing against the shaping element and in this way to be held on the holding element via the shaping element.

This solution can have the advantage that the preferably plastic deformation of the material of the wall results in secure retention of same on the shaping element and the holding element. Correspondingly, in particular clamping of the wall can be omitted.

Preferably, it can be provided for the material of the walls to be deformed in particular plastically such that the wall is held on the respective shaping element preferably exclusively by a form fit.

Preferably, it can be provided for the opening of the bag to be enlarged by corresponding movement of at least one holding element, wherein a wall of the bag slides over the shaping elements until the deformation of the wall is carried out by the shaping element(s) while the bag is correspondingly open.

Preferably, the bag is accordingly unfolded by the holding elements, wherein the wall(s) of the bag slide over the shaping elements and/or the holding elements and are then preferably plastically deformed by the shaping elements with corresponding tensioning of the wall(s).

Preferably, it can be provided for the shaping elements to bear against the wall such that the preferably plastic deformation takes place at a distance from an edge of the wall of the bag.

The solution can have the advantage that damage to the bag, in particular tearing toward the bag edge or opening, can be avoided.

Preferably, it can be provided for the initial spacing of the walls of the bag to be carried out by means of at least one suction element, which acts on the outside of a wall to be spaced and opens the bag, wherein it can preferably be provided for the wall of the bag not to be clamped between the suction element and the holding element.

Preferably, it can be provided for the at least one suction element to be preferably deactivated and/or disengaged after the initial spacing of the walls of the bag, so that the bag continues to be held in the open position only by the holding elements.

A device according to the invention is a device for filling bags with products, preferably by a method as taught herein, wherein the bags have an opening via which the bags can each be filled with at least one product, and wherein walls of the bag can be spaced apart from one another in the region of the opening in order to introduce the at least one product into the bag via the opening, and wherein, after the walls are spaced apart and before the at least one product is supplied, holding elements are introduced into the bag through the opening in order to hold the open bag in the region of the opening, characterized in that the device has at least some holding elements, which each have at least one shaping element against which a wall of the bag bears in each case and are designed to deform the material of the wall preferably plastically in order to hold the wall on the respective holding element via the respective shaping element. Accordingly, it is provided for the device to have at least some holding elements, which each have at least one shaping element against which a wall of the bag bears in each case and are designed to deform the material of the wall preferably plastically in order to hold the wall on the respective holding element via the respective shaping element.

Preferably, it can be provided for the or each shaping element to have an in particular hemispherical or dome-shaped bulge, wherein it is preferably provided for the bulge to have a radius of at least 1 mm.

A suitable radius can avoid a situation in which the material of the bag is pierced during deformation.

Preferably, it can be provided for the or each shaping element to be designed to deform the material of the walls in particular plastically such that the wall is held on the respective shaping element by a form fit.

Preferably, it can be provided for at least some holding elements to be designed as holding fingers, which can be positioned with a free end protruding into the opening of the bag, wherein each holding finger has a shaping element, which is preferably arranged in the region of a free end of the holding finger.

Preferably, at least two holding elements are used, which each have preferably one shaping element and are used on a wall of the bag to open the bag. A further holding element, preferably without a shaping element, is used on another side of the bag, in particular as a counterholder.

Preferably, it can be provided for the device to be designed to position the at least one shaping element at a distance from an edge of the opening of the bag.

Preferably, it can be provided for the distance to be such that the material of the wall of the bag between the bearing face of the shaping element and the edge of the bag is not under a tensile force directed along the transport path of the products into the bag.

Preferably, it can be provided for the transition from the respective shaping element to the corresponding holding element to be rounded.

An advantage of this solution can consist in avoiding sharp edges in this region and assisting better sliding of the bag material when the bag is pulled off.

Preferably, it can be provided for at least one holding element to be at least partially rounded in cross section outside the shaping element.

An advantage of this solution can likewise consist in that it is made easier for the bag material to slide over the holding element.

Preferably, it can be provided for a region of the holding element that pivots into the bag to be trapezoidal in cross section.

An advantage of this solution can consist in being able to absorb, as well as possible, the load occurring in this region and resulting from the bag material being tensioned thereover.

Preferably, it can be provided for at least one holding element to have an L-shaped form, wherein the material strength in the corner region of the L-shaped holding element is higher than other regions, in particular in order to protect the holding element from bending open and any occurring transverse bending resulting from the walls of the bag being unfolded.

Preferably, it can be provided for at least one holding element to be mounted pivotably so that the holding fingers with the shaping element can be pivoted into the bag. A corresponding pivoting-in mechanism for the holding element(s) can be operated pneumatically, electrically, magnetically or mechanically.

BRIEF DESCRIPTION OF THE DRAWINGS

A preferred exemplary embodiment of the invention is explained below using the drawings. In the figures.

DETAILED DESCRIPTION OF PREFERRED EMBODIMENTS

Figure 1:
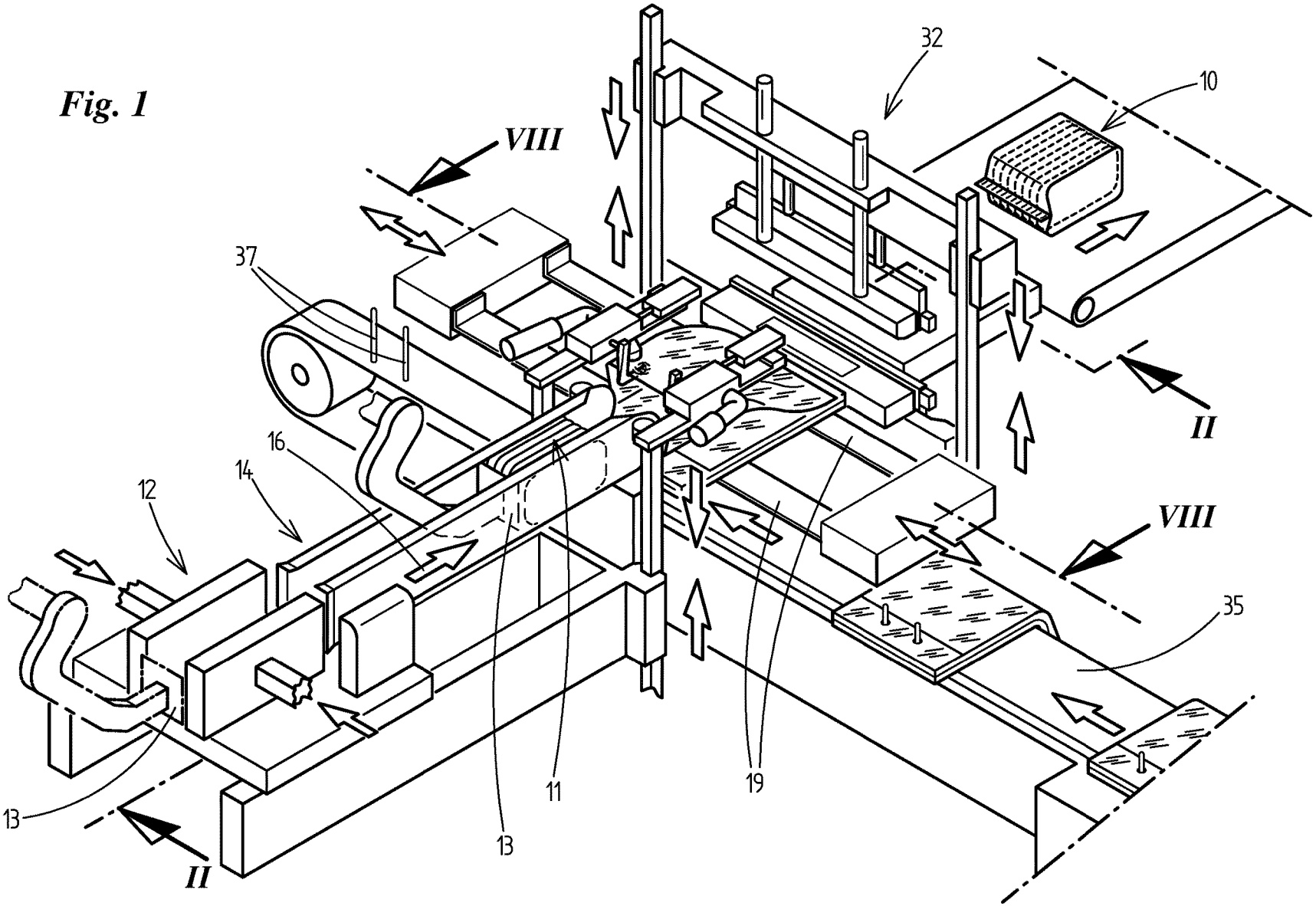
FIG. 1 shows a device for filling bags in a schematic, three-dimensional diagram.

The invention is described below with reference to a device for packaging groups of diapers into bags 10. Since other articles are, however, also possible as package contents, the general term product 11 is used below. The product 11 to be packaged also does not have to be a group of products; one or more individual products or multiple groups of products are also possible. In this respect, the terms are used synonymously below.

The products 11 are supplied as a group to a compressing station 12. Here, the group of products 11 is then compressed and subsequently pushed into a shuttle 14 by means of a pushing means 13. The compressing station 12 can be considered useful for the present groups of diapers but can of course be omitted for other products.

The shuttle 14 can be, as shown, an elongate guide that can be moved back and forth in the transport direction 16 and holds the group of products 11 together laterally and in a compressed state. Other guides known from the prior art are also conceivable here.

The method consists substantially of the following steps:

The pushing means 13 and the shuttle 14 are conveyed together with the group of products 11 in the transport direction 16 to a bag-opening station 15. In the bag-opening station 15, bags 10, folded flat, are kept ready one above the other in stacks in a bag magazine 17. The respective bag stacks are conveyed toward the bag-opening station 15 and positioned correspondingly under same (see FIG. 1). The bag stacks are lifted by means of a lifting station 18, received by two movable fork holders 19, and brought to the height level of the shuttle 14 (see FIG. 2).

It is self-evident that the bags 10 can of course also be processed individually, and therefore the bag magazine 17 shown here can be omitted, at least at this point or overall.

Suction elements in the form of a pair of suction grippers 22 are lowered onto the top wall 20 of the top bag 10 and suck up and hold the upper wall 20. When the suction elements are subsequently lifted, the upper wall 20 is carried along and the bag 10 is opened slightly. As a counterpart to the lifting, a lower wall 21 of the bag 10 is held by a bottom plate 23 that protrudes into the bag 10. In this way, the bottom plate 23 acts as a holding element for the bag 10.

When the bag 10 is slightly opened in this way (by lifting with the suction elements), two further holding elements 24, 25 pivot into it. The suction elements and the pivoted-in holding elements 24, 25 move further upward and carry the wall 20 with them.

The holding elements 24, 25 are shaped such that they each have a shaping element 26 on their free end or in the vicinity thereof. In the present case, the shaping elements 26 are each designed as bulges 27.

Figure 8:
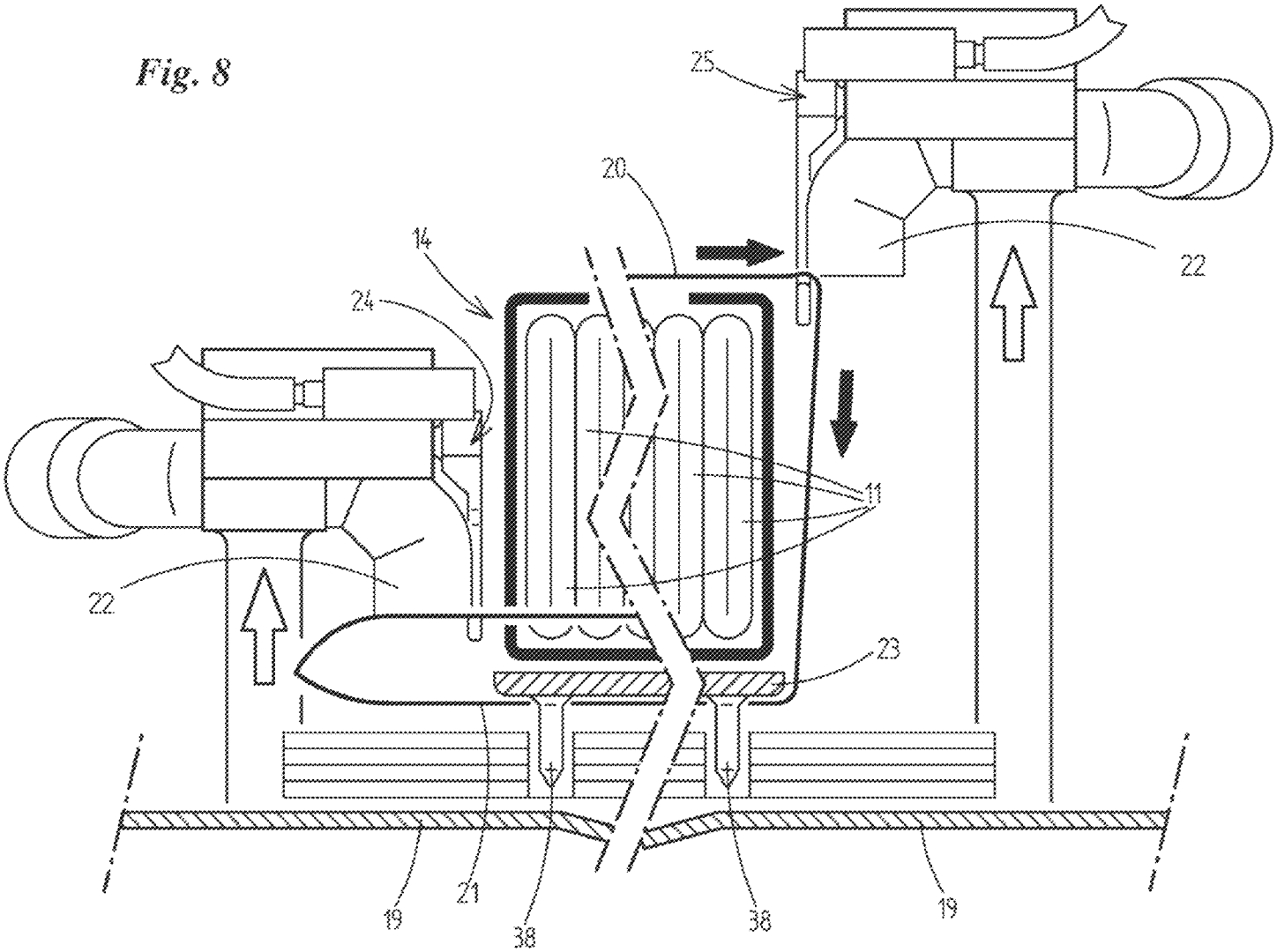
FIG. 8 shows a vertical section through the device along section line VIII-VIII in FIG. 1 in successive movement phases.

During the upward movement of the suction elements and the holding elements 24, 25, the bag material is not clamped fixedly between them, but rather the upper wall 20 of the bag 10 is tensioned over the holding elements 24, 25 and the respective shaping elements 26 thereof so that a rectangular (bag) opening 28 is formed (see FIG. 8).

Figure 5:
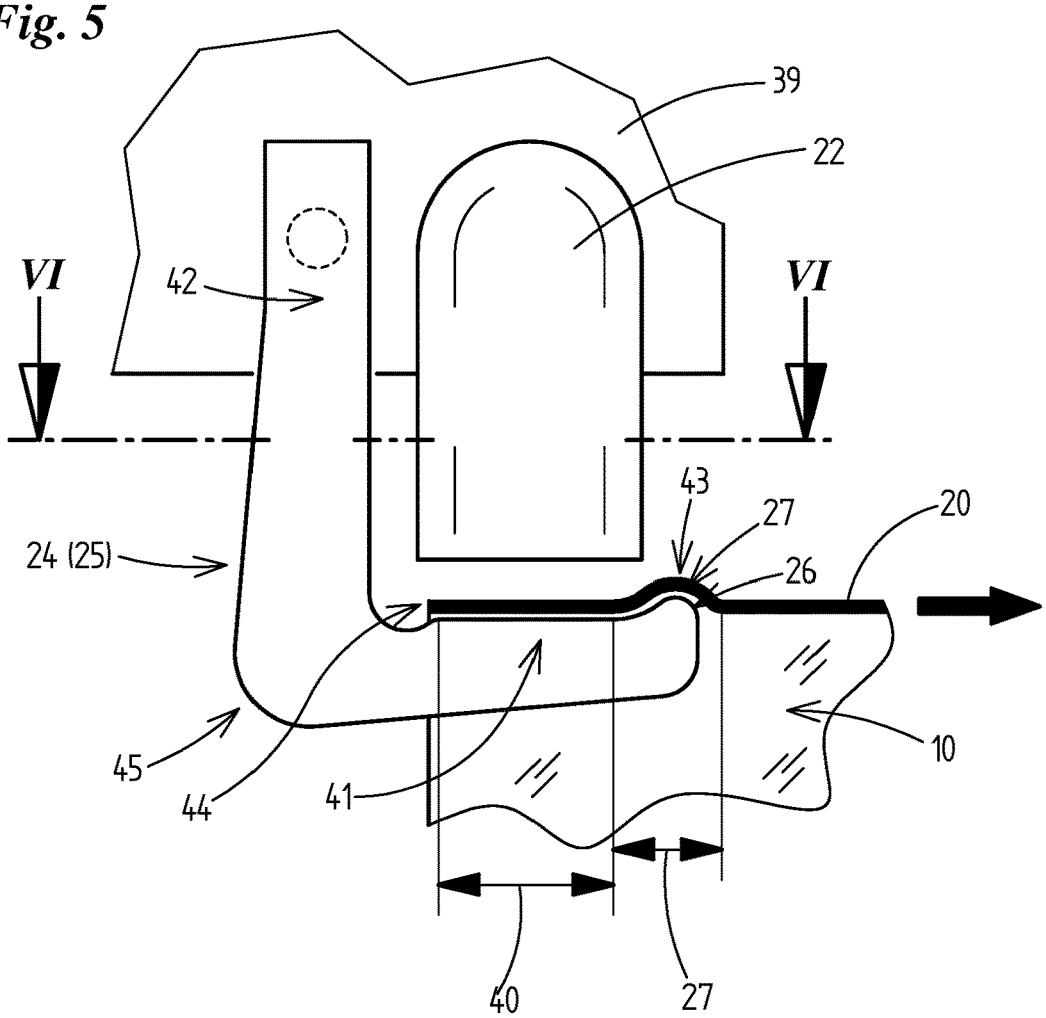
FIG. 5 shows a detail of the device on an enlarged scale in region VI in FIG. 4.

The contour of the bulge 27 causes the bag material to be deformed (overstretched) plastically over same at the end of the unfolding process but without tearing. The form-fitting connection thus produced between the bag material and the shaping element 26 means that the tensile force 29 that arises during the insertion of the shuttle 14 into the bag 19 and is directed in the transport direction 16 (see FIG. 5 and FIG. 6) is absorbed via the bag material. Via the resistance thus introduced, the bag 10 is held securely during the entire insertion process, and uncontrolled sliding of the bag 10 off the holding elements 24, 25 is prevented.

Since fixed clamping of the bag material is not used in this method, a further advantage results: Throughout the opening of the bag 10, the material of the upper wall 20 can slide unhindered into the unfolding side walls. As a result of the tensile forces 30 that arise during unfolding and are directed transversely to the transport direction 16, the upper wall 20 is tensioned, and therefore the wall 20 is prevented from sagging in the unfolded state of the bag 10. Both the product 11 and the shuttle 14 can be inserted unhindered into the open bag 10.

The suction elements can either remain activated during unfolding of the bag 10 or be switched off after the bag 10 is opened. As shown in FIG. 8, the wall 20 is pulled or peeled off the suction elements during unfolding of the bag 10, and therefore the suction elements are then no longer needed in any case and can be deactivated if desired.

When the shuttle 14 and the pushing means 13 move into the open bag 10, the group of products 11 is conveyed to just before the bottom 31 of the bag 10. The shuttle 14 is then moved back toward the starting position, while the pushing means 13 pushes the products 11 out of the shuttle 14 as far as the bottom 31 of the bag 10.

The pushing means 13 then pushes the products 11 further toward a sealing/cutting station 32, and the bag 10 is pulled off the holding elements 24, 25 in the process.

Figure 7:
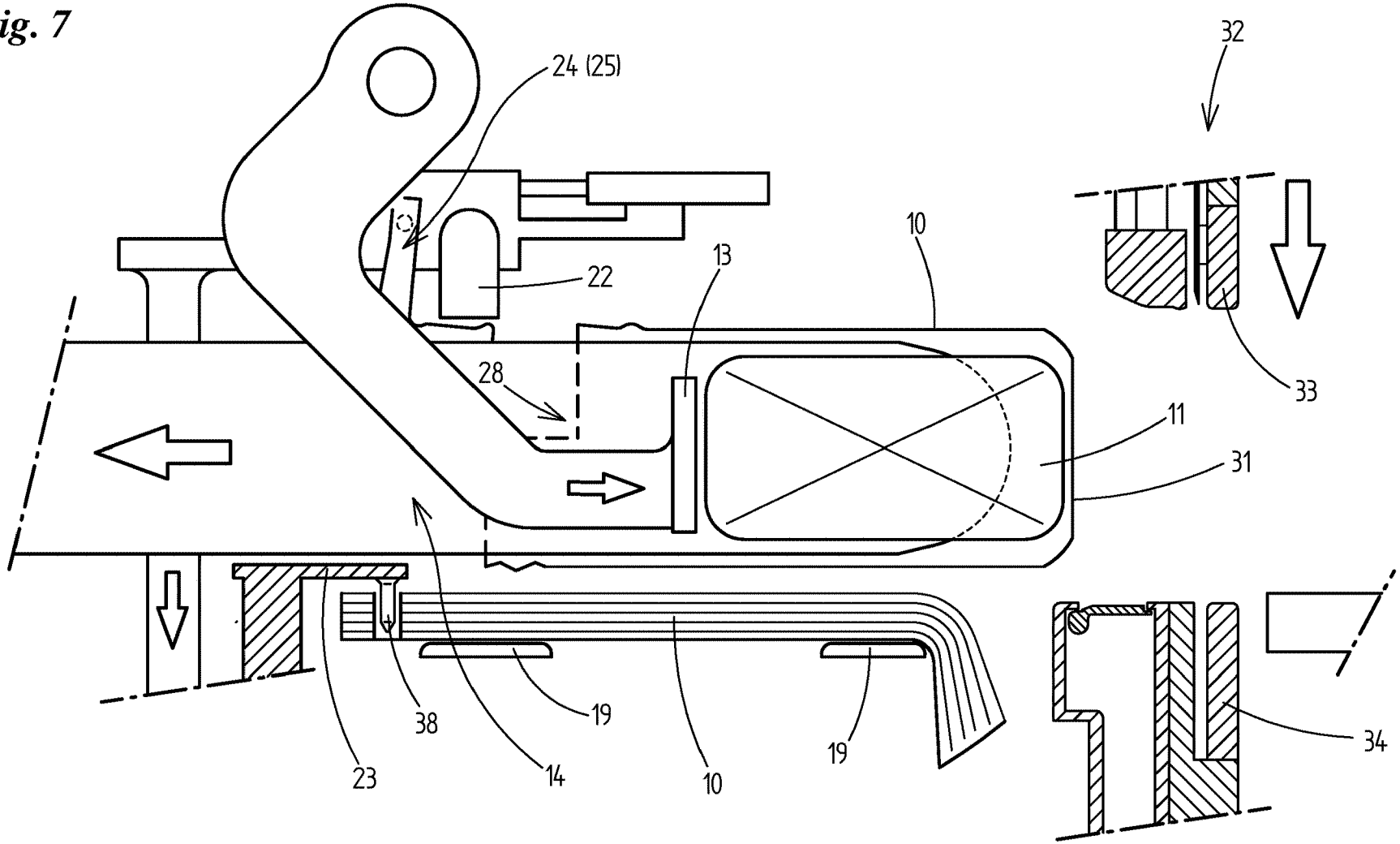
FIG. 7 shows a diagram corresponding to FIG. 2 on an enlarged scale.

Overlapping with the movement of the shuttle 14 toward the starting position, the suction elements and the holding elements 24, 25 are already lowered again to pick up the next bag 10 (see FIG. 7). This movement overlap is possible because both the suction elements and the holding elements 24, 25 are structurally located outside of the working region of the shuttle 14 (see FIG. 8).

Finally, the filled bag 10 is supplied to a sealing/cutting station 32 in which the bag 10 is closed in a known manner (see right-hand region of FIG. 7). This means that an end-face bag seam is fused by means of sealing jaws 33, 34 moved toward one another, and the excess material is cut off before it is removed from the machine via a suction duct (see right-hand region of FIG. 2). With the material thus cut off, the plastic deformations in the bag material, caused by the overstretching on the bulge 27, are also removed from the finished bag 10.

In the case of large bags 10 (e.g., for multi-row diaper formats), the region in which the bag 10 is unfolded can also be critical just because of the holding elements 24, 25 with the bulge 27. The weight of the bag 10 and the overhang thereof in the bag supply can mean that the bag 10 is pulled off the bulges 27 of the holding elements 24, 25 while it is being pulled open (range between initial opening by suction element and complete unfolding by and via the holding elements 24, 25).

In order to ensure reliable opening of large bags 10, the opening process can be designed as follows:

First, the suction elements lowered onto the bag magazine 17 (as described above) grip the upper wall 20 and create a first opening gap. The holding elements 24, 25 with bulges 27 pivot into this gap until they come to a stop against a fixed counterpart (e.g., the suction elements). In the process, the bag material is correspondingly clamped fixedly between the holding elements 24, 25 and the counterpart. The bag 10 thus remains in position while being pulled open and cannot be pulled off the holding elements 24, 25.

Shortly before the suction elements and the pivoted-in holding elements 24, 25 reach their upper end position, the holding elements 24, 25 are pivoted away (slightly) from their counterpart, the fixed clamping of the bag material is opened, and the unfolding of the bag 10 continues only via the holding elements 24, 25. Here too, the material is then correspondingly overstretched over the bulges 27 on the holding elements 24, 25 and held as already described above until the bag 10 with the products 11 is finally pulled off by means of the pushing means 13.

Figure 2:
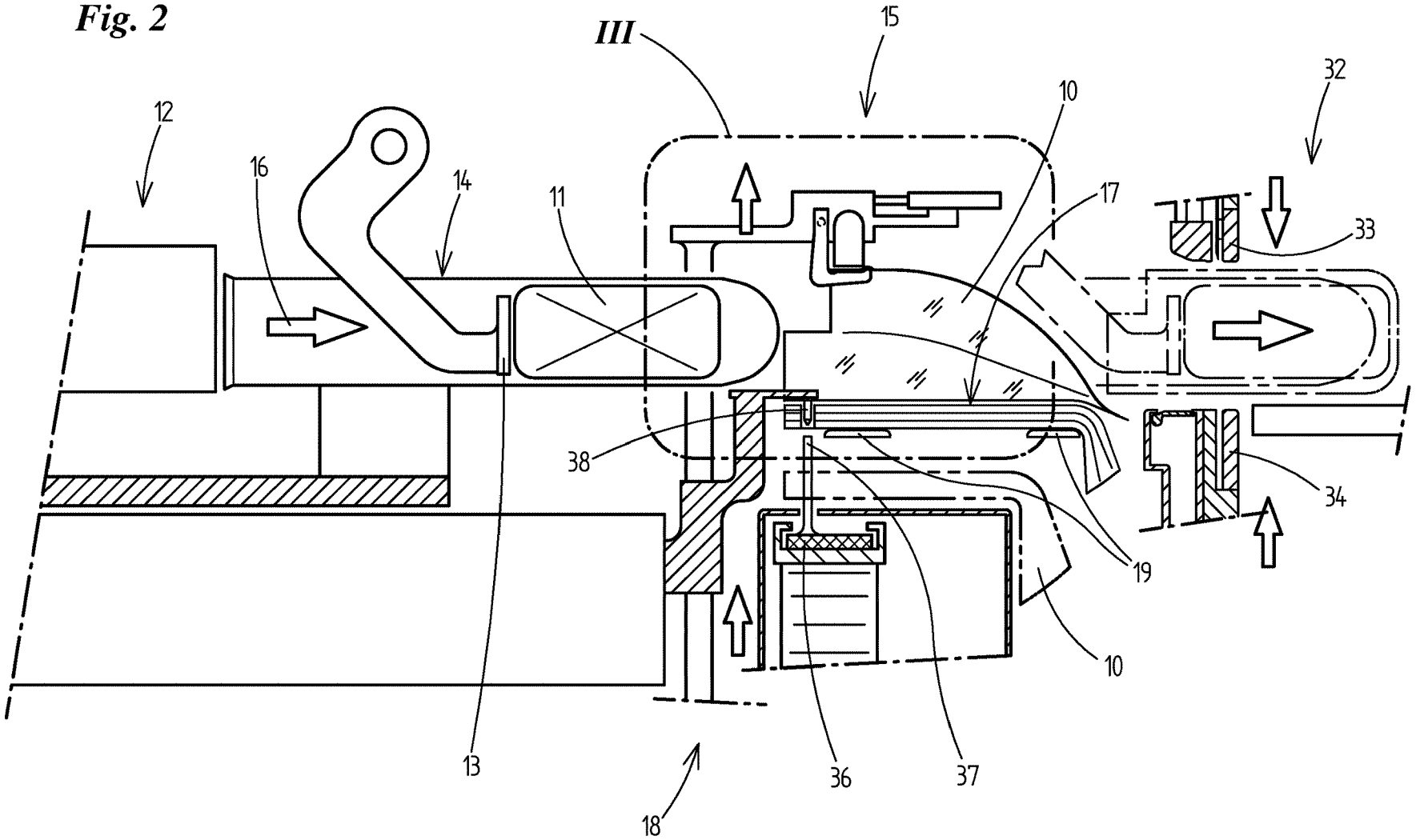
FIG. 2 shows a vertical section through the device along section line II-II in FIG. 1, FIGS. 3 and 4 show a detail of the device on an enlarged scale in region III in FIG. 2 in successive movement phases.
Figure 3:
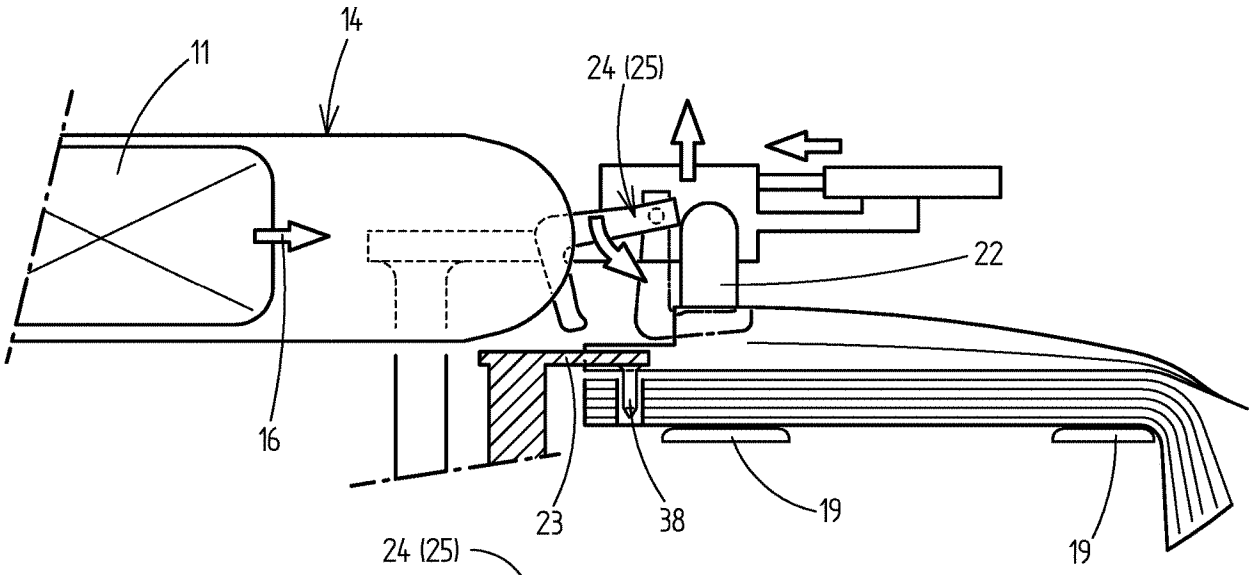
Figure 4:
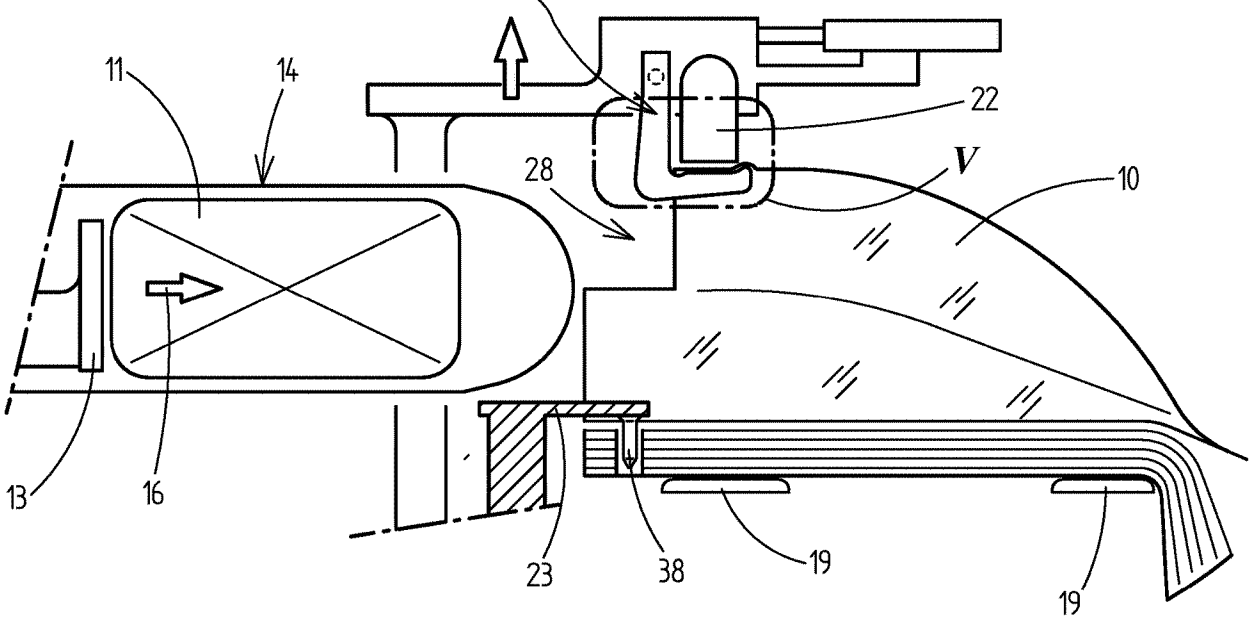

The device also has the following characteristics:

The bag stacks are supplied to the bag magazine 17 along a track plate 35. Transport takes place by means of a toothed belt 36 that has pins 37 that engage (from below) into corresponding holes in the bags 10. When the bag stack is lifted, the bags are pulled off the pins 37, and pins 38 on the bottom plate 23 engage (from above) into the holes (FIGS. 2 and 3).

The holding elements 24, 25 are in the form of holding fingers. The holding elements 24, 25 are arranged pivotably on a holder 39, on which a suction element is also mounted. In this way, a holding element 24, 25 can be moved together with a suction element (in the vertical direction).

The holding elements 24, 25 preferably have the bulge 27 at a free end. In each case, a portion with a flat top is arranged in front of the bulge 27. This so-called straight region 40 ensures that the plastic deformation only takes place in the region of the bulge 27 that is set back relative to the bulge 27 and not in the straight region 40.

The holding elements 24, 25 are L-shaped in cross section, with two arms that meet in a corner region 45. The arm protruding into the bag 10 has the bulge 27 and the straight region 40 and acts as a holding finger 41. The other arm 42 is used for pivotable mounting on the holder 39.

Figure 6:
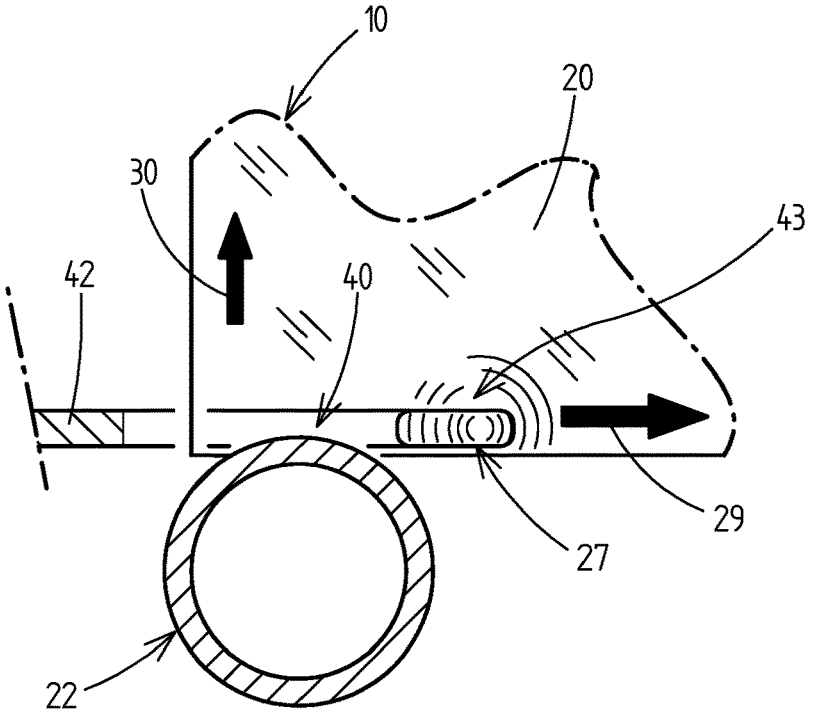
FIG. 6 shows a horizontal section through the device along section line VI-VI in FIG. 5.

FIG. 6 shows the region in which the preferably plastic deformation 43 is arranged, specifically at a distance from the bag edge 44.

It is also provided for the transition from the respective shaping element to the corresponding holding element 24, 25 to be rounded. In this way, sharp edges can be avoided in this region in order to assist better sliding of the bag material when the bag 10 is pulled off.

Furthermore, it is provided for the holding elements 24, 25 to be at least partially rounded in cross section outside the shaping element in order to make it easier for the bag material to slide over the holding elements 24, 25.

It is also provided for a region of the holding elements 24, 25 that pivots into the bag, specifically the holding fingers 41, to be trapezoidal in cross section. An advantage of this solution can consist in being able to absorb, as well as possible, the load occurring in this region and resulting from the bag material being tensioned thereover.

It is also provided for the material strength in the corner region 45 of the holding elements 24, 25 to be higher than other regions, in particular in order to protect the holding elements 24, 25 from bending open and any occurring transverse bending as a result of the unfolding of the walls of the bag 10.

A pivoting-in mechanism for the holding element(s) 24, 25 can be operated, for example, pneumatically, electrically, magnetically or mechanically.

It is self-evident that the bags 10 can of course also be handled in another orientation and do not have to lie flat. Accordingly, the bag 10 is then aligned in an appropriate direction. In this respect, the invention is not limited to the horizontal/vertical orientation shown but can in principle also be implemented in other orientations.

LIST OF REFERENCE SIGNS

10 Bag
11 Product
12 Compressing station
13 Pushing means
14 Shuttle
15 Bag-opening station
16 Transport direction
17 Bag magazine
18 Lifting station
19 Fork holder
20 Wall (upper)
21 Wall (lower)
22 Suction gripper
23 Bottom plate
24 Holding element
25 Holding element
26 Shaping element
27 Bulge
28 Opening (bag)
29 Tensile force (longitudinal)
30 Tensile force (transverse)
31 Bottom (bag)
32 Sealing/cutting station
33 Sealing jaw
34 Sealing jaw
35 Track plate
36 Toothed belt
37 Pin (toothed belt)
38 Pin (bottom plate)
39 Holder
40 Region
41 Holding finger
42 Arm
43 Deformation
44 Bag edge
45 Corner region

The invention claimed is:

1. A method for filling bags (10) with products (11), wherein the bags (10) have an opening (28) via which the bags are each filled with at least one product (11), and wherein walls (20, 21) of the bag (10) are spaced apart from one another in the region of the opening (28) in order to introduce the at least one product (11) into the bag (10) via the opening (28), and wherein, after the walls (20, 21) are spaced apart and before the at least one product (11) is supplied, holding elements (24, 25) are introduced into the bag (10) through the opening (28) in order to hold an upper wall (20) of the open bag (10) in the region of the opening (28), while a lower wall (21) is held by a bottom plate (23) that protrudes into the bag (10), wherein the holding elements (24, 25) each have at least one shaping element (26) with a hemispherical or dome-shaped bulge (27) against which the upper wall (20) of the bag (10) bears in each case such that the material of the wall (20) is deformed in order to hold the upper wall (20) on the respective holding element (24, 25) via the respective shaping element (26), and wherein the holding elements (24, 25) are arranged pivotably on a holder (39), on which a suction element is also mounted.

2. The method as claimed in claim 1, wherein the material of the upper wall (20) is deformed such that the upper wall (20) is held on the respective shaping element (26).

3. The method as claimed in claim 1, wherein the opening (28) of the bag (10) is enlarged by corresponding movement of at least one holding element, wherein the upper wall (20) of the bag (10) slides over the shaping elements (26) until the deformation (43) of the upper wall (20) is carried out by the at least one shaping element (26) while the bag (10) is correspondingly open.

4. The method as claimed in claim 3, wherein the at least one shaping element (26) bears against the upper wall (20) such that the deformation (43) takes place at a distance from an edge (44) of the upper wall (20) of the bag (10).

5. The method as claimed in claim 1, wherein the initial spacing of the walls (20, 21) of the bag (10) is carried out by means of at least one suction element, which acts on the outside of the upper wall (20) to be spaced and opens the bag (10), wherein it can be provided for the upper wall (20) of the bag (10) not to be clamped between the suction element and the holding element.

6. The method as claimed in claim 5, wherein the at least one suction element is deactivated and/or disengaged after the initial spacing of the walls (20, 21) of the bag (10), so that the bag (10) continues to be held in the open position only by the holding elements (24, 25).

7. A device for filling bags (10) with products (11), the device having holding elements (24, 25), wherein the bags (10) have an opening (28) via which the bags can each be filled with at least one product (11), and wherein walls (20, 21) of the bag (10) can be spaced apart from one another in the region of the opening (28) in order to introduce the at least one product (11) into the bag (10) via the opening (28), and wherein, after the walls (20, 21) are spaced apart and before the at least one product (11) is supplied, the holding elements (24, 25) are introduced into the bag (10) through the opening (28) in order to hold an upper wall (20) of the open bag (10) in the region of the opening (28), while a lower wall (21) is held by a bottom plate (23) that protrudes into the bag (10), wherein the holding elements (24, 25) each have at least one shaping element (26) with a hemispherical or dome-shaped bulge (27) against which the upper wall (20) of the bag (10) bears in each case and is designed to deform the material of the upper wall (20) in order to hold the upper wall (20) on the respective holding element (24, 25) via the respective shaping element (26), and wherein the holding elements (24, 25) are arranged pivotably on a holder (39), on which a suction element is also mounted.

8. The device as claimed in claim 7, wherein the dome-shaped bulge (27) has a radius of at least 1 mm.

9. The device as claimed in claim 7, wherein the at least one shaping element (26) is designed to deform the material of the walls (20, 21) such that the upper wall (20) is held on the respective shaping element (26) by a form fit.

10. The device as claimed in claim 7, wherein the holding elements (24, 25) are designed as holding fingers (41), which can be positioned with a free end protruding into the opening (28) of the bag (10), wherein each of the holding fingers (41) has the at least one shaping element (26), which is arranged in the region of a free end of the respective one of the holding fingers (41).

11. The device as claimed in claim 10, wherein the device is designed to position the at least one shaping element (26) at a distance from an edge of the opening (28) of the bag (10).

12. The device as claimed in claim 11, wherein the distance is such that the material of the upper wall (20) of the bag (10) between the bearing face of the shaping element and the edge (44) of the bag (10) is not under a tensile force directed in the transport direction (16) of the products into the bag (10).

13. The device as claimed in claim 7, wherein the transition from the respective shaping element (26) to the corresponding holding element (24, 25) is rounded.

14. The device as claimed in claim 7, wherein the at least one of the holding elements (24, 25) is at least partially rounded in cross section outside the shaping element.

15. The device as claimed in claim 7, wherein a region of the corresponding holding element (24, 25) that pivots into the bag (10) is trapezoidal in cross section.

16. The device as claimed in claim 7, wherein the at least one holding element (24, 25) has an L-shaped form, wherein the material strength in the corner region (45) of the L-shaped holding element (24, 25) is higher than at least one other region of the L-shaped holding element (24, 25).

17. The device as claimed in claim 7, wherein the at least one holding element (24, 25) is mounted pivotably so that the holding finger(s) (41) with the at least one shaping element (26) can be pivoted into the bag (10).

* * * * *